US007066250B2

(12) United States Patent
Webb et al.

(10) Patent No.: US 7,066,250 B2
(45) Date of Patent: Jun. 27, 2006

(54) WELL TUBING/CASING VIBRATOR APPARATUS

(75) Inventors: Lloyd A. Webb, Midland, TX (US); Thomas D. Southall, Graford, TX (US); Wayne M. Biart, Willow Park, TX (US); Orvie E. Berg, Rock Springs, WY (US)

(73) Assignee: DHR Solutions, Inc., Rock Springs, WY (US)

( * ) Notice: Subject to any disclaimer, the term of this patent is extended or adjusted under 35 U.S.C. 154(b) by 182 days.

(21) Appl. No.: 10/760,617

(22) Filed: Jan. 20, 2004

(65) Prior Publication Data

US 2005/0155758 A1 Jul. 21, 2005

(51) Int. Cl.
*E21B 28/00* (2006.01)

(52) U.S. Cl. ..... 166/177.6; 175/56

(58) Field of Classification Search ..... None
See application file for complete search history.

(56) References Cited

U.S. PATENT DOCUMENTS 2,999,540 A 9/1961 Bodine, Jr.
3,152,642 A 10/1964 Bodine, Jr.
3,155,163 A 11/1964 Bodine, Jr.
3,239,005 A 3/1966 Bodine, Jr.
4,366,988 A 1/1983 Bodine
4,393,932 A 7/1983 Bodine
4,429,743 A 2/1984 Bodine
4,621,688 A 11/1986 Bodine
4,640,360 A 2/1987 Bodine et al.
5,234,056 A 8/1993 Bodine et
6,412,560 B1 7/2002 Bernat
6,464,014 B1 10/2002 Bernat
6,550,536 B1 4/2003 Bernat

*Primary Examiner*—Zakiya W. Bates
(74) *Attorney, Agent, or Firm*—Gardere Wynne Sewell LLP

(57) ABSTRACT

A vibrator apparatus for inducing longitudinal vibrations in a well tubing or casing member for various operations, or for removing stuck tubing or casing. The apparatus includes a vibrator section with spaced apart rotatable shafts carrying eccentric weights and interconnected by timing gears. The shafts are driven by respective pressure fluid motors. The vibrator section is mounted on an isolator section including spaced apart pressure fluid cylinder assemblies for isolating vibrations generated by the apparatus from wellhead structure supporting the apparatus. A fluid flow circuit includes a pump, a manifold, flow control devices for generating fluid flow through the cylinder assemblies and accumulators for damping fluid pressure and flow fluctuations in the circuit.

25 Claims, 8 Drawing Sheets

WELL TUBING/CASING VIBRATOR APPARATUS

BACKGROUND OF THE INVENTION

In the art of well drilling and completing operations there has been a long-standing need for apparatus which can effectively vibrate or oscillate a tubing or casing string for various purposes, including improving primary wellbore cementing operations, releasing stuck tubing or casing and other operations, such as fishing operations, gravel packing and workover operations and the like. However, several problems remain effectively unsolved with regard to the provision of vibrator apparatus which can be connected to the upper end of well tubing, including coil tubing, or casing, and impart oscillatory vibrational forces to such tubular members without damaging associated well structure and inducing vibration of the tubular member at a resonant frequency which provides for a more effective and less energy consuming operation.

Effectively isolating vibrations induced by vibrator apparatus from associated well structure supporting the vibrator apparatus has been a somewhat nettlesome problem. Moreover, ease of modifying the vibrational forces generated by the apparatus, such as changing the mass of rotating eccentric weights, for example, has also been a problem which has received little attention in prior art vibrator apparatus. There has also been a need to provide vibrator apparatus whereby the tubular member being vibrated can also be rotated while connected to the vibrator apparatus. Still further, the provision of a system which is operable to drive rotating eccentric weight shafting and also provide for operation of a hydraulic or pneumatic vibration absorbing structure has also, heretofore, not been satisfactorily addressed in the art of well tubing or casing vibrator apparatus.

Accordingly, the present invention provides improvements which address problems in the art of well tubular member vibrator apparatus and provides certain advantages in such apparatus heretofore unknown.

SUMMARY OF THE INVENTION

The present invention provides an improved apparatus for inducing vibrations in well tubular members, including drill pipe, casing, tubing strings and coil tubing, for example.

In accordance with one aspect of the present invention, a vibrator apparatus is provided which is adapted to mount on a well structure, such as a blowout preventer, support the upper end of a tubular member and transmit oscillatory vibrations to the tubular member for various purposes. A preferred embodiment of the apparatus utilizes counter-rotating shafts with eccentric weights mounted thereon and disposed in an arrangement which is symmetrical with respect to the axis of a well casing or tubing, the counter-rotating shafts being interconnected by suitable timing gearing and preferably being independently driven by pressure fluid motors or the like.

In accordance with another aspect of the invention, a vibrator apparatus is provided which is mountable on a wellhead structure, such as a blowout preventer or the like, and provides a vibration inducing or transmitting section connected to a well tubular member and supported by a hydraulic or pneumatic vibration absorbing system, such as an arrangement of piston and cylinder devices, for example. A fluid flow circuit is connected to the cylinders which support the vibrator section of the apparatus and which operate to damp vibrations produced by the vibrator section of the apparatus with respect to wellhead structures supporting the apparatus. The fluid flow circuit is operable to provide a pressure fluid charge in the arrangement of cylinders for supporting the vibrator section of the apparatus and to provide for flow of fluid through the cylinders during oscillatory or vibratory movement of the tubular member and the vibrator section of the apparatus.

In accordance with still another aspect of the present invention, a vibrator apparatus for vibrating wellbore tubular members is provided which includes means for rotating the tubular member or members while connected to the vibrator apparatus and while the vibrator apparatus is in operation as well as when the vibrator apparatus is deenergized.

In accordance with yet a further aspect of the present invention, a well tubing or casing vibrator apparatus is provided which is constructed to be reliable in operation, relatively easily serviced, relatively maintenance free, wherein rotating eccentric weights may be interchanged for weights of different mass relatively easily and conveniently as the operational requirements may dictate, and wherein drilling fluids may be circulated through tubing or casing connected to the apparatus.

Those skilled in the art will further appreciate the above-mentioned advantages and superior features of the vibrator apparatus of the present invention upon reading the detailed description which follows in conjunction with the drawings.

DETAILED DESCRIPTION OF PREFERRED EMBODIMENTS

Figure 1:
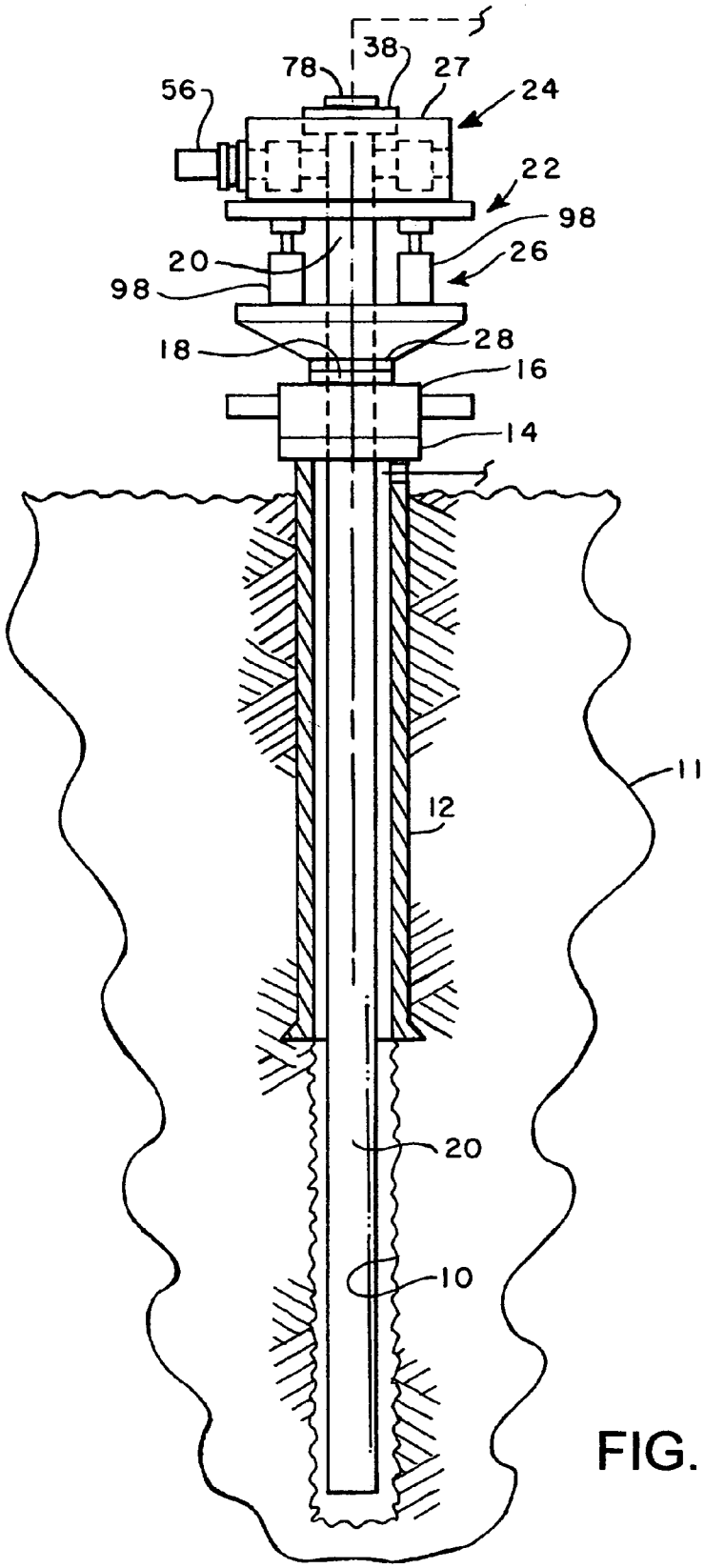
FIG. 1 is a somewhat schematic diagram of a well wherein a well tubular member is shown connected to one preferred embodiment of a vibrator apparatus in accordance with the present invention.

In the description which follows, like parts are marked throughout the specification and drawing with the same reference numerals, respectively. The drawing figures are not necessarily to scale and certain elements may be shown in somewhat schematic form in the interest of clarity and conciseness.

Referring to FIG. 1, there is illustrated, in somewhat schematic form, a wellbore 10 penetrating an earth formation 11 and having disposed in place a surface casing 12.

Surface casing 12 extends to a wellhead structure including a support flange 14 and further structure mounted thereon, including, for example, a blowout preventer 16. Blowout preventer 16, preferably includes an upwardly facing mounting flange 18. The wellhead structure including the flange 14 and blowout preventer 16 are exemplary and are commonly in place during many types of wellbore operations including drilling and cementing operations, for example.

Referring further to FIG. 1, there is illustrated an elongated cylindrical tubular member 20, such as a casing, drillpipe or other well tubular member, disposed in wellbore 10, extending upwardly through the blowout preventer 16 and operably connected to a tubing or casing vibrator apparatus in accordance with the invention and generally designated by the numeral 22. Vibrator apparatus 22 includes a vibrator mechanism section 24 and a support and isolator section 26. Isolator section 26 includes a downwardly facing mounting flange 28 which is operable to be supported on and connected to the flange 18 of blowout preventer 16, the flanges 18 and 28 being suitably connected by machine bolts, in a conventional manner, not shown in FIG. 1. Vibrator apparatus 22 is operable to induce longitudinal oscillatory vibrations to the tubular member 20 to enhance cementing operations, free the member 20, if stuck in the wellbore 10, and be used in other well operations where inducing longitudinal vibrations into a tubing or casing member is advantageous.

Figure 2:
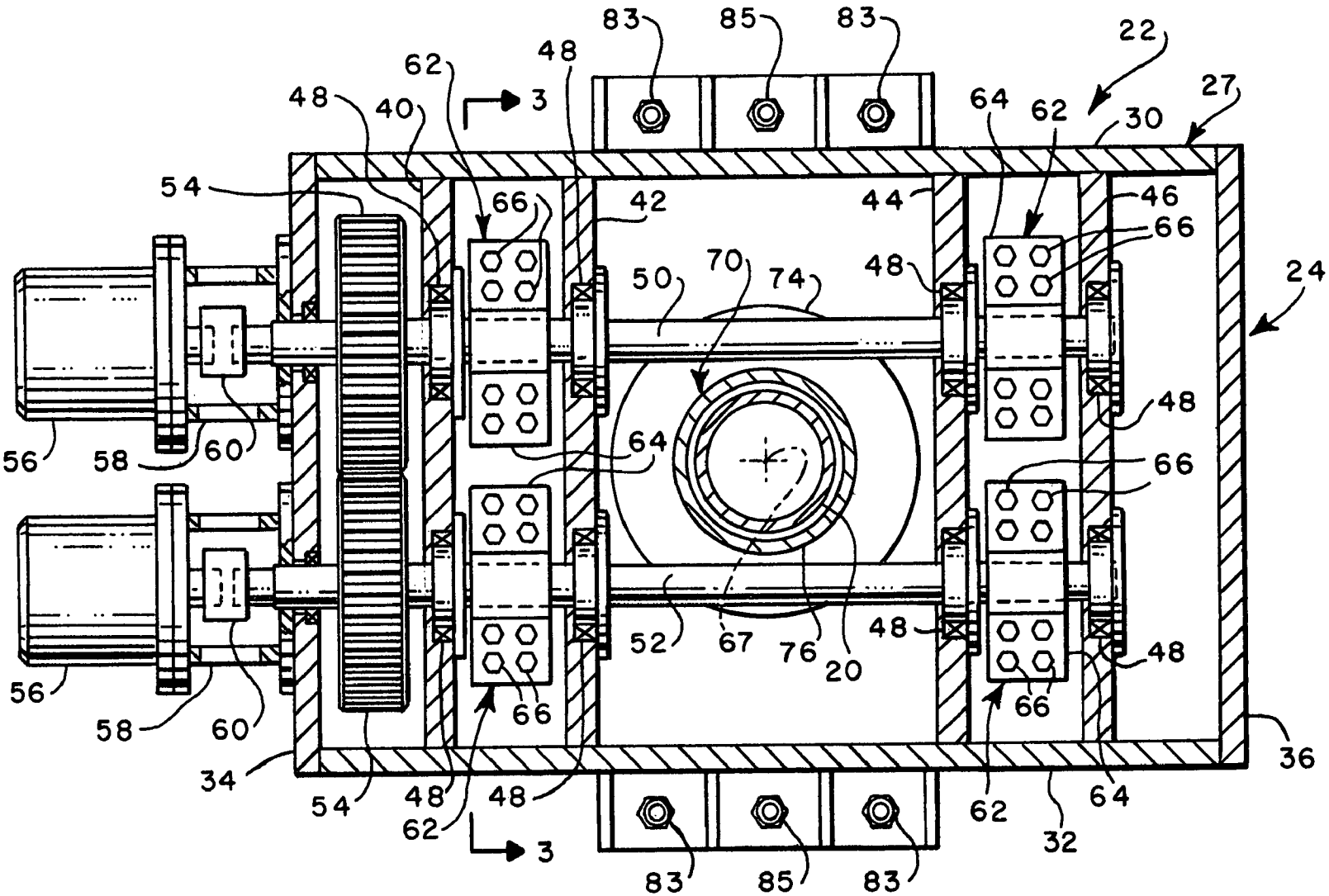
FIG. 2 is a section view taken generally along the line 2—2 of FIG. 3.
Figure 3:
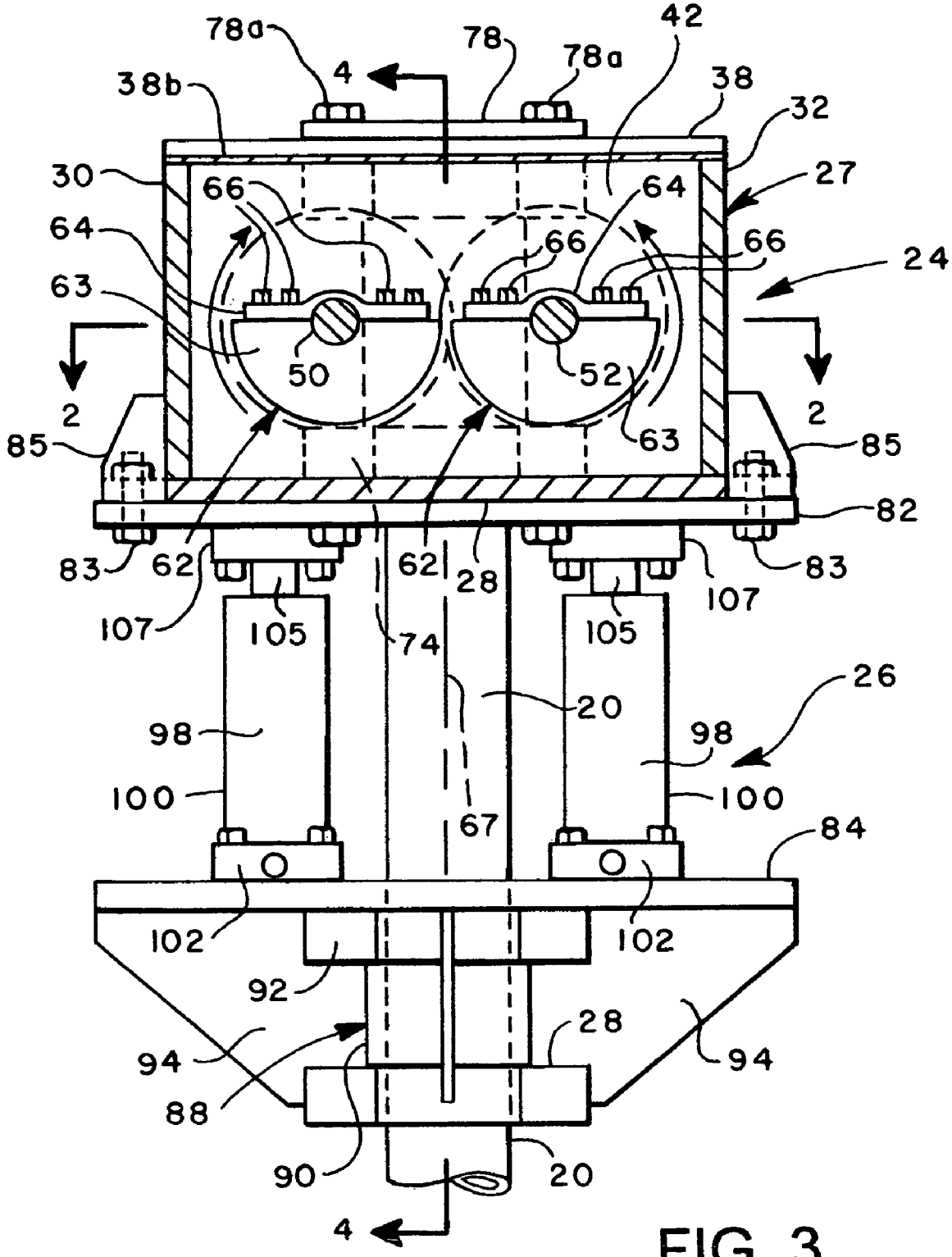
FIG. 3 is a section view taken generally along the line 3—3 of FIG. 2.

Referring now to FIGS. 2 and 3 also, the vibrator section 24 of the apparatus 22 includes a generally rectangular boxlike frame 27 including a bottom wall 28, FIG. 3, opposed side walls 30 and 32, opposed end walls 34 and 36, FIG. 2, and a top wall 38, FIG. 3. As shown in FIG. 2, spaced apart, transverse intermediate walls 40, 42, 44 and 46 provide support for respective bearing assemblies 48 mounted on the respective walls and adapted to rotatably support respective parallel, eccentric weight drive shafts 50 and 52, as shown in FIGS. 2 and 3.

Figure 4:
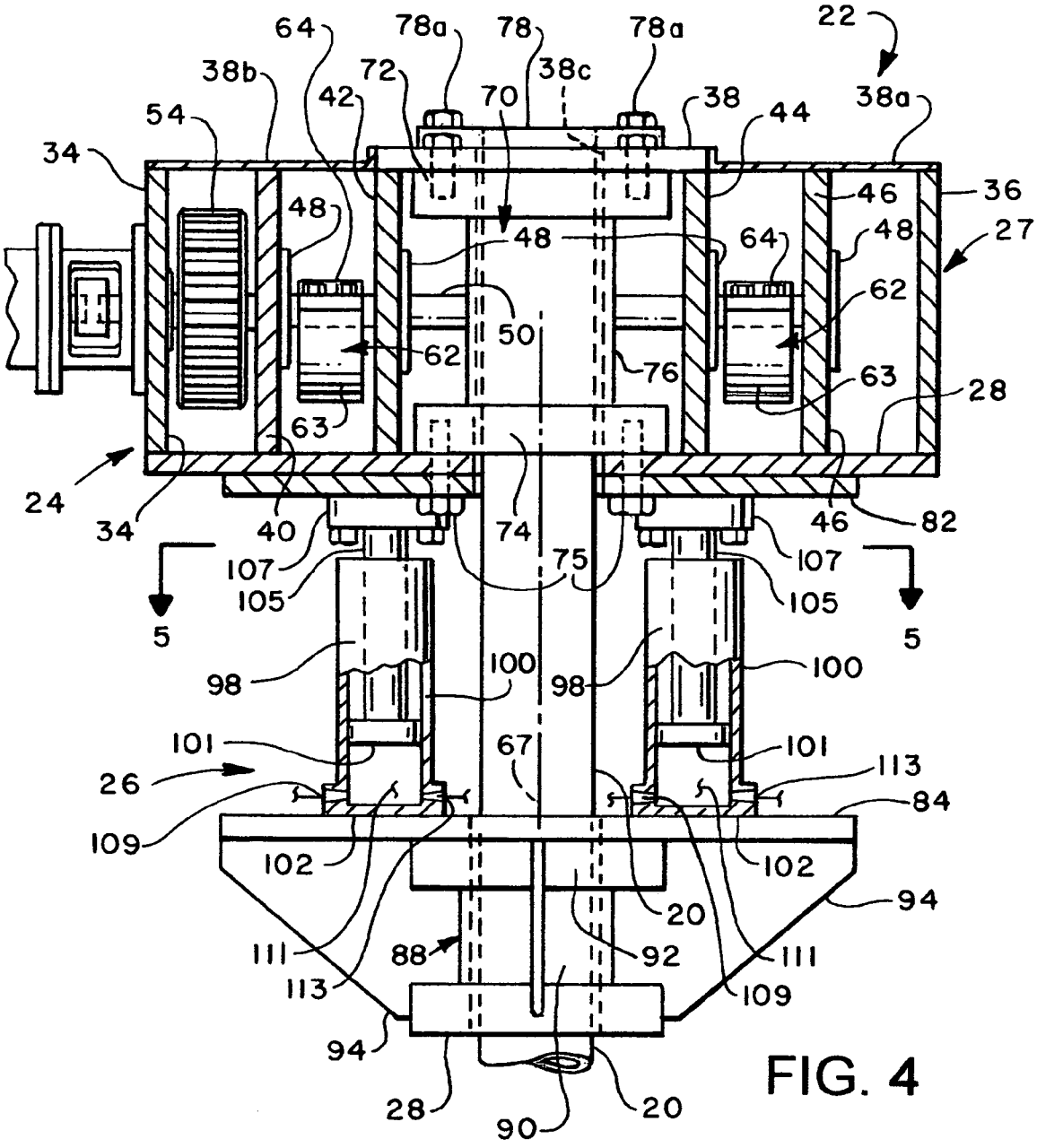
FIG. 4 is a section view taken generally along the line 4—4 of FIG. 3.

As shown in FIGS. 3 and 4, top wall 38 extends between sidewalls 30 and 32 and between intermediate walls 42 and 44 and suitable lighter weight inspection covers 38*a* and 38*b* cover the remainder of the top surface of frame 27. Top wall 38 is operable to be secured to the frame 27 at the sidewalls 30 and 32 and the intermediate walls 42 and 44 by conventional fasteners, not shown, or by welding, if desired. Drive shafts 50 and 52 are adapted to support respective spur gears 54 which are meshed with each other to maintain synchronization between the shafts 50 and 52 as they rotate. Drive shafts 50 and 52 extend through suitable bores in end wall 34 and are drivenly connected to respective hydraulic motors 56 mounted on suitable brackets 58, respectively, and connected to end wall 34. Rotary hydraulic motors 56 are driveably connected to the shafts 50 and 52 by respective self aligning and vibration isolating drive couplings 60 of conventional design.

Each of shafts 50 and 52 support spaced apart eccentric weight assemblies 62, as shown in FIG. 2, which are disposed on the respective shafts, as illustrated in FIG. 2, between the sets of intermediate walls 40 and 42 and 44 and 46, respectively. In this way the eccentric weight assemblies 62 are mounted on the shafts 50 and 52 adjacent points where the shafts are supported and very close to respective pairs of bearing assemblies 48, as illustrated in FIG. 2. The bearing assemblies 48 may comprise spherical-type anti-friction ball bearing assemblies of a type commercially available. Drive and timing gears 54 are preferably conventional spur or helical type gears and disposed in a closeable chamber 61 of the frame 27 and which may include a suitable gear lubricant disposed therein for providing lubrication to the meshed gears 54. Bearing assemblies 48 may also be provided with lubricant fittings, not shown, for periodic lubrication thereof, although bearing assemblies 48 may be also be of a sealed type.

As shown in FIGS. 2 and 3, eccentric weight assemblies 62 each include a substantially half-cylindrical weight 63 adapted to mount on the shaft 50 or 52 and be secured thereto by a cap 64, as shown, for releasably clamping the weights to the shafts, respectively, for rotation therewith. Each of the weight retaining caps 64 is provided with suitable machine bolt fasteners 66, FIGS. 2 and 3 for releasably securing the weight members 63 to the shafts 50 and 52 for rotation therewith and at spaced apart points, as illustrated. The weight assemblies 62 are preferably spaced apart equidistant from a central axis 67, FIGS. 2 and 3, so that, upon rotation of the shafts 50 and 52, the eccentric weights 63 will rotate in timed relationships and impart longitudinally directed shaking forces in opposite directions along axis 67.

Referring now to FIG. 4, the vibrator section 24 of apparatus 22 includes a generally tubular support or spool member 70 including opposed spaced apart flanges 72 and 74 and an intermediate tubular section 76. Lower flange 74 is suitably secured to frame bottom wall 28 for transfering vibratory forces generated by the rotating eccentric weight assemblies 62 to the member 76 and the flange 72. A suitable opening 38*c* in wall 38 provides clearance for tubular member 20. Accordingly, when a tubular member is connected to the apparatus 22, longitudinal oscillations or vibrations may be imposed on the member, such as the tubular member 20 shown in FIG. 4. One manner of connecting the tubular member 20 to the vibrator section 24 is by providing a suitable flange 78 secured to the upper end of the member 20 and bolting the flange 78 to the flange 72 and/or the top wall 38 with conventional machine bolts 78*a*. Top wall 38 may also be bolted to flange 72, as shown. Other means for securely connecting the tubular member 20 to the vibrator section 24 of apparatus 22 may be provided, as will be described hereinbelow. A suitable conduit may be connected to the tubular member 20 at flange 78 for circulating fluid through the tubular member into or out of wellbore 10, for example, during operation of apparatus 22.

Figure 5:
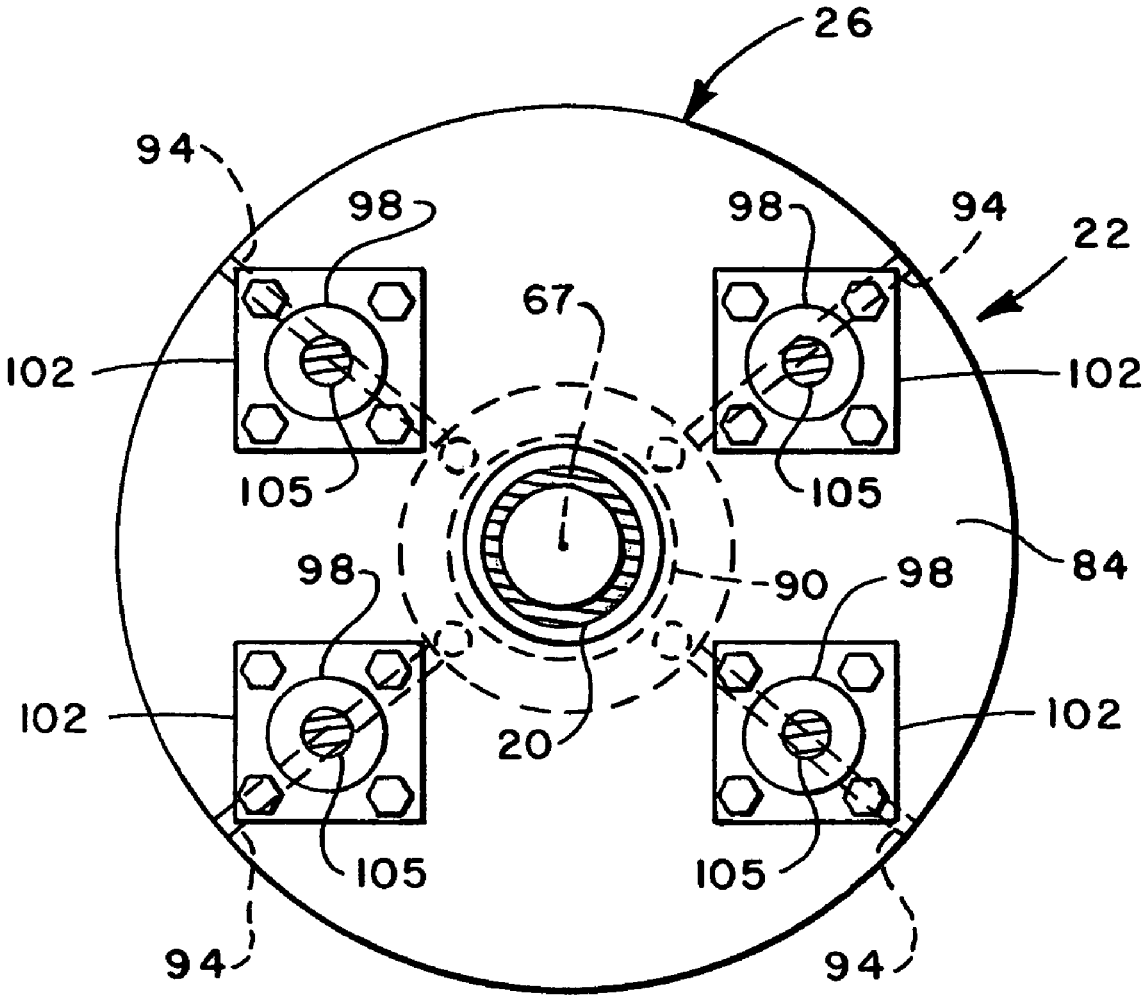
FIG. 5 is a section view taken from the line 5—5 of FIG. 4.

The apparatus 22 is further characterized by the support and isolator section 26 previously mentioned and illustrated in further detail in FIGS. 3, 4 and 5. The support and isolator section 26 is characterized by spaced apart support plate members 82 and 84. Support plate member 82 is adapted to be securely fastened to the frame 27 of vibrator section 24 in a conventional manner by mechanical fasteners 83 or by welding, as desired. Opposed gusseted flanges 85 may be provided on frame 27, as illustrated in FIGS. 2 and 3, for firmly securing plate member 82 to the opposed side walls 30 and 32 of the frame 27. Plate member 82 may also be secured to bottom wall 28 and/or flange 74 by machine bolt fasteners 75, FIG. 4. Support plate 84 is firmly secured to a spool member 88 including the flange 28, a tubular member 90 and a second flange 92, as shown in FIGS. 3 and 4. As shown in FIGS. 4 and 5, tubular member 20 extends down through the spool member 88 including the hollow tubular member 90 and the flanges 28 and 92. Circumferentially spaced gussets 94, FIGS. 3, 4, and 5, are provided to reinforce the connection between the support plate 84 and the spool 88.

As further shown in FIGS. 3, 4, and 5, support plates 82 and 84 of the section 26 are interconnected by four equally spaced apart pressure fluid cylinder and piston assemblies 98. Cylinder assemblies 98 each include an elongated cylinder 100 and a piston and rod assembly including a piston 101 and rod 105, FIG. 4, slidably disposed therein in a conventional manner. Each cylinder 100 is supported on plate 84 by a rectangular base 102 suitably bolted to the plate and the distal end of the piston rod 105 of each piston and rod assembly is operably connected to support plate 82 by a flange 107 suitably bolted to plate 82, as illustrated. Cylinder assemblies 98 are preferably single acting and pressure fluid is introduced into respective cylinder chambers 111 at supply ports 109, one at the base of each cylinder assembly, as shown by way of example in FIG. 4. Fluid may exit each cylinder assembly 98 through a second port 113, FIG. 4, as explained in further detail herein.

Pressure fluid introduced into each of cylinder assemblies 98 operates to extend the piston and rod assemblies thereof to at least support the weight of the vibrator section 24 and the tubular member 20 connected thereto during operation of the vibrator apparatus 22. Moreover, the support and isolator section 26 is also operable to damp vibrations generated by the vibrator section 24 to avoid transferring substantial harmful unbalanced forces to wellhead structure, such as the blowout preventer 16, for example. Moreover, the cylinder assemblies 98 may be pressurized to extend piston rods 105 and thereby raise the vibrator section 24 and the tubular member 20 connected thereto should the member 20 be stuck thereby assisting any vibratory action imposed on the member 20 by operation of the apparatus 22 in unsticking, or moving the member 20 for other purposes.

Operation of the apparatus 22 is believed to be understandable to those of ordinary skill in the art based on the foregoing description. Pressure fluid is supplied to motors 56 to rotate the respective shafts 50 and 52 with the weight assemblies 62 mounted thereon and positioned as illustrated in FIGS. 2 and 3 in synchronization with each other as maintained by the timing gears 54. The rotational speed of the shafts 50 and 52 may be varied for purposes of finding a resonant frequency of a casing or tubing member having a nominal diameter up to about thirteen or fourteen inches. The rotative speeds of the shafts 50 and 52 normally would not require to be greater than about 1,000 rpm and in many cases significantly lower rotative speeds may be required. During operation of the vibrator section 24, pressure fluid is also supplied to the cylinder assemblies 98 to urge the piston rods 105 upward, viewing FIGS. 3 and 4, to at least support the weight of the vibrator section 24, the weight of any tubing or casing connected thereto, such as the tubular member 20, and to compensate for longitudinal vibratory unbalanced forces being exerted by the vibrator section 24 along the axis 67.

Figures 6, 7:
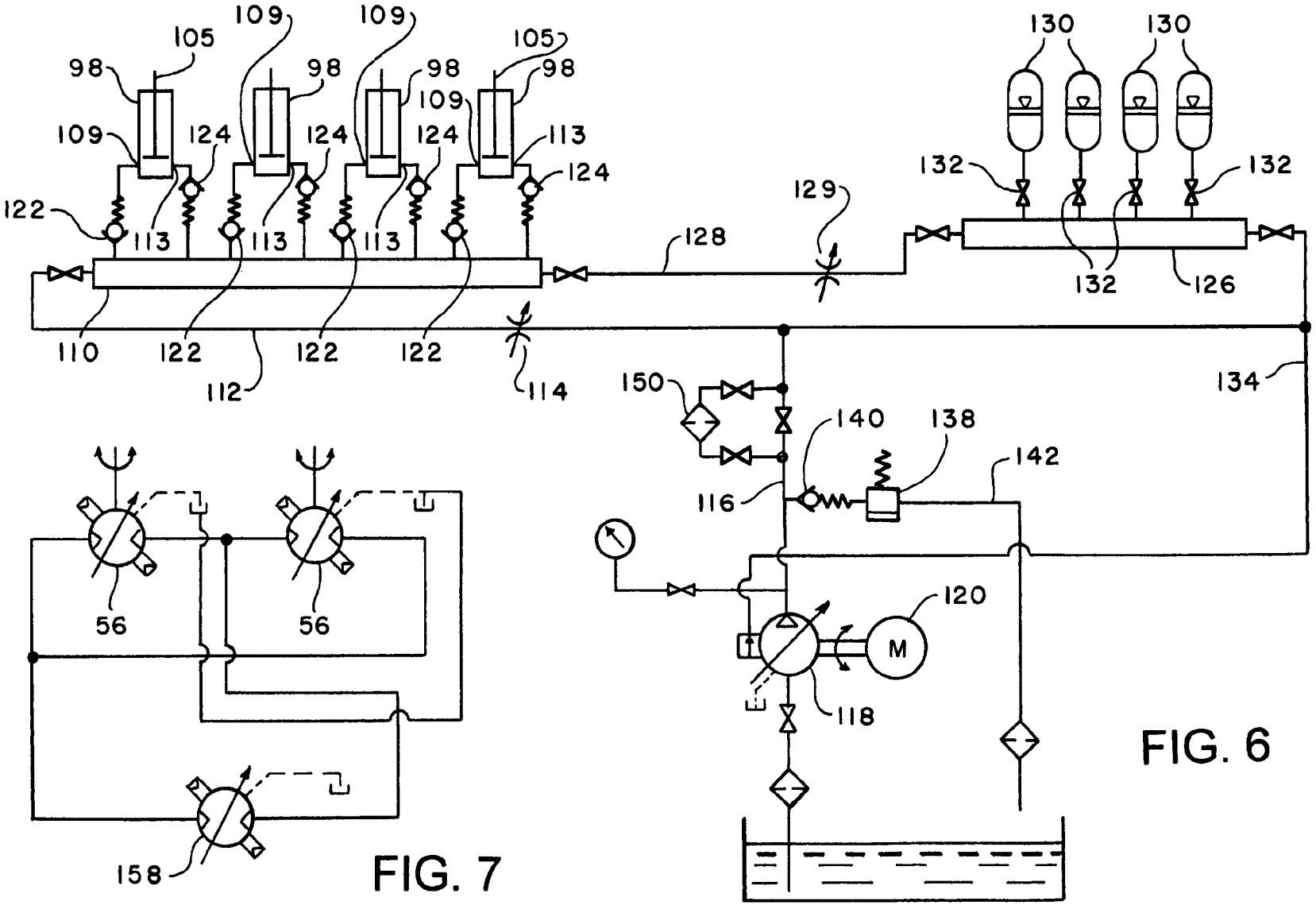
FIG. 6 is a schematic diagram of a pressure fluid flow circuit for the vibration isolator cylinders of the vibrator apparatus.
FIG. 7 is a schematic diagram of a fluid flow circuit including a pump and motor arrangement for driving the eccentric weight drive shafts.

Referring now to FIGS. 6 and 7, there are illustrated preferred pressure fluid circuits for the support section 26 and the vibrator section 24, respectively. Referring to FIG. 6, pressure fluid is supplied to the respective cylinder assemblies 98 by way of a manifold 110 connected to a supply conduit 112 having a suitable throttling or flow control valve 114 disposed therein. Conduit 112 is connected to a supply conduit 116 which is connected to a pressure compensated hydraulic pump 118 suitably driven by an electric motor 120. Fluid inlet check valves 122 are disposed between fluid inlet ports 109 of the respective cylinder assemblies 98 and the manifold 110 and fluid return check valves 124 are connected to the respective cylinder assemblies 98 to allow fluid to flow out of cylinder chambers 111 by way of the ports 113 of the cylinder assemblies, respectively, and back to the manifold 110. Accordingly, as the cylinder assemblies 98 experience rapid short stroke reciprocation of their respective piston and rod assemblies during operation of apparatus 22, pressure fluid is pumped into and out of cylinder chambers 111, FIGS. 4 and 6, thanks to the arrangements of the check valves 122 and 124.

Manifold 110 is also connected to a second manifold 126 by way of a conduit 128 and throttling valve 129. Manifold 126 is operably connected to multiple hydraulic fluid accumulators 130. Adjustable flow control valves 132 are interposed manifold 126 and the respective accumulators 130. Accumulators 130 are preferably arranged four in parallel, as shown, so as to more effectively and reliably absorb pulsations in the fluid flow circuit of FIG. 6 and provide pressure fluid to the cylinder assemblies 98. A conduit 134 returns fluid to the pump 118. A pressure regulator valve 138 and a check valve 140 are operably interposed in a bypass conduit 142 connected to pump discharge conduit 116, as illustrated. A suitable reservoir 144 may be provided for supplying makeup fluid to the control system illustrated in FIG. 6 for the support and isolator section 26. A filter circuit including a fluid filter 150 is illustrated as being operably connected to pump discharge conduit 116 for periodically cleaning hydraulic fluid used in the system illustrated and described.

Although the pressure fluid control circuit illustrated in FIG. 6 has been shown and described as a hydraulic circuit, the present invention contemplates that a pneumatic circuit may be utilized also in place of the hydraulic circuit illustrated. For example, the hydraulic pump 118 may be replaced by a suitable compressor supplying pressure air to the respective cylinder assemblies 98 by way of a manifold similar to the manifold 110. Pressure air exiting the aforementioned manifold may be suitably regulated to maintain a controllable pressure in the manifold as well as the chambers 111 of the cylinder assemblies 98.

Referring briefly to FIG. 7, a generalized circuit diagram for driving the motors 56 is also illustrated. Each of motors 56, as illustrated, is operably connected to a reversible pump 158, FIG. 7, for driving the motors 56 in a selected direction of rotation. Conventional hydraulic circuit components may be utilized in the circuitry of FIG. 7 to provide variable speed output from the motors 56 to the respective eccentric weight shafts 50 and 52.

The above-described embodiment of the present invention is one wherein the tubular member 20 is not rotated with respect to the vibrator apparatus 22. However, referring now to FIG. 8, there is illustrated an embodiment of the apparatus of the invention, generally designated by the numeral 222 wherein the vibrator section 24 has been modified with respect to the frame 27 in such a way that top wall 38 supports a mechanism 160 providing for rotation of the tubular member 20. Mechanism 160 supports a conventional slip bowl 162 for receiving conventional pipe or tubular member slips 164 and wherein the upper end of the tubular member 20 may be connected to a suitable mechanism for rotating the tubular member, such as a power swivel 166, for example. Power swivel 166 may be of a type which provides for circulation of fluids therethrough and into and through tubular member 20. Power swivel 166 is shown connected to a suitable bail 168 which may be connected to a traveling block assembly of a drilling or workover rig, not shown. Power swivel 166 and bail 168 may be of types known to those skilled in the art. In like manner, the slip bowl 162 and slips 164 may also be of types known to those skilled in the art.

Figure 8:
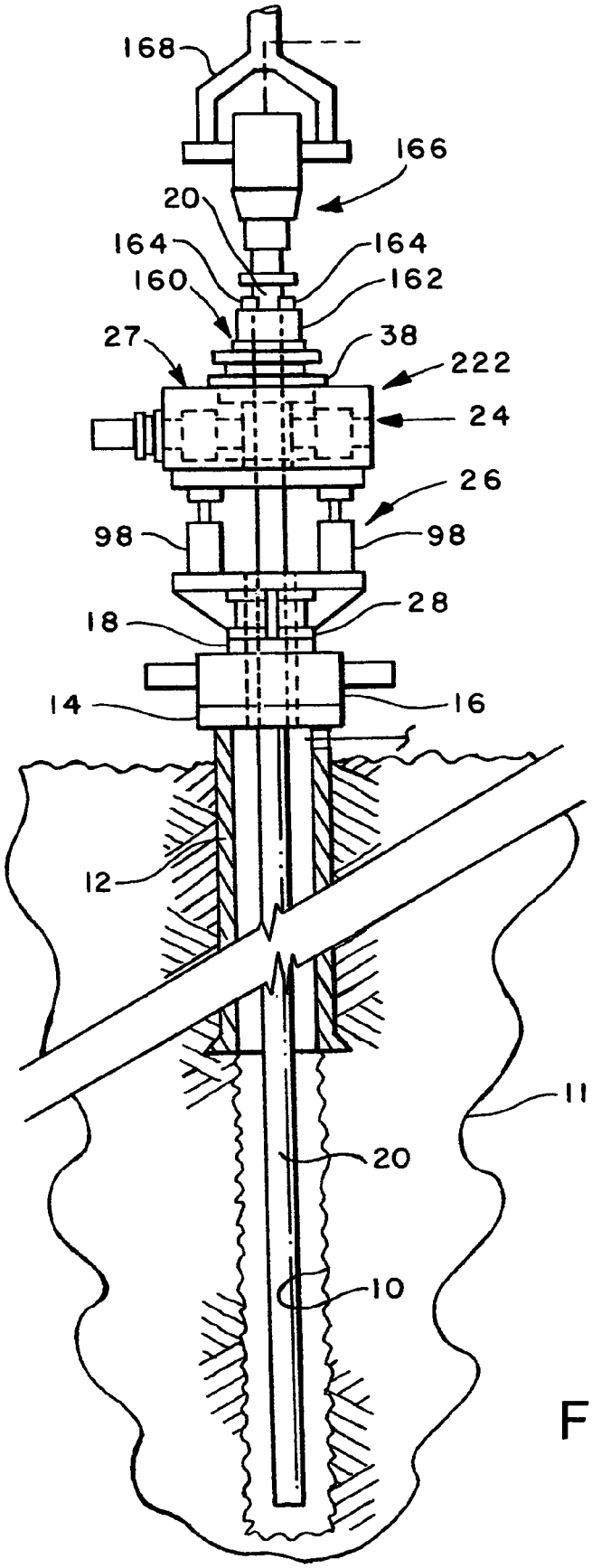
FIG. 8 is a somewhat schematic diagram of another preferred embodiment of the present invention connected to a well tubular member extending into a wellbore.
Figure 9:
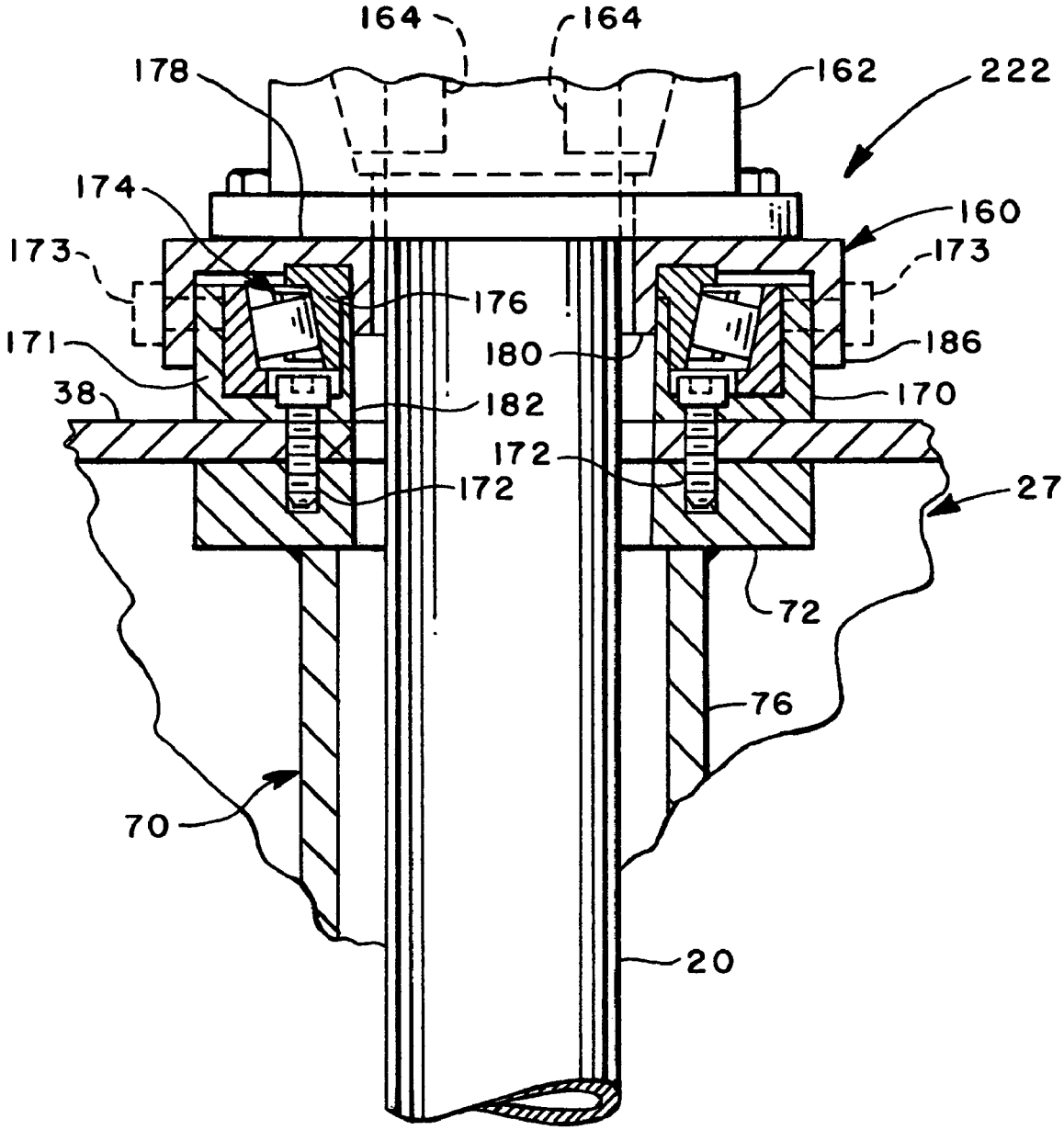
FIG. 9 is a detail view, partially sectioned, illustrating mechanism for rotating the tubular member while connected to the vibrator apparatus.

Referring briefly to FIG. 9, the mechanism 160 is illustrated in some detail and is characterized by a generally cylindrical bearing support and retainer member 170 which is mountable on the top wall 38 and is suitably secured thereto by machine bolts 172. Bearing retainer member 170 supports a conventional bearing assembly, such as a tapered roller bearing, generally designated by the numeral 174. The inner race 176 of bearing assembly 174 is suitably engaged with a generally cylindrical cap 178 having a central, axially projecting cylindrical spigot portion 180 which may be slip fitted into a central bore 182 formed in the bearing retainer member 170. Cap 178 includes a peripheral downward facing collar part 186 which is fittable over the peripheral wall 171 of the bearing retainer member 170 and is rotatable relative thereto. However, the cap 178 may be locked to the bearing support and retainer member 170 by one or more suitable removable lock pins 173, as shown in FIG. 9. As further shown in FIG. 9, the slip bowl 162 is adapted to be suitably mounted on the cap 178 and secured to the cap for rotation therewith for rotating the tubular member 20. Accordingly, the vibrator apparatus 222 illustrated in FIGS. 8 and 9, is substantially like the apparatus 22 except for the modification illustrated and described.

Conventional pressure fluid circuit components may be utilized in the circuits of FIGS. 6 and 7 for operation of the apparatus 22 or 222. Moreover, conventional engineering materials and fabrication processes may be used to manufacture the apparatus 22 and 222, including the vibrator section 24 and the support and isolator section 26. Although preferred embodiments of the invention have been described in detail herein, those skilled in the art will recognize that various substitutions and modifications may be made without departing from the scope and spirit of the appended claims.

What is claimed is:

1. A vibrator apparatus for connection to a well tubular member for imparting longitudinal vibrations thereto, said vibrator apparatus comprising:

a vibrator section including a member adapted to be connected to an elongated well tubular member for transferring vibrations thereto;

a support section disposed between said vibrator section and a wellhead structure for supporting said apparatus on said wellhead structure, said support section including pressure fluid support and isolation members operably supporting said vibrator section, said support and isolation members comprising plural cylinder assemblies; and a fluid flow circuit including a pump for supplying pressure fluid to said cylinder assemblies, respectively.

2. The apparatus set forth in claim 1 wherein:

said cylinder assemblies include extensible pistons for elevating said vibrator section with respect to said wellhead structure.

3. The apparatus set forth in claim 2 wherein:

said support section includes a flange for mounting said vibrator apparatus on said wellhead structure, a support plate connected to said flange and supporting said cylinder assemblies and said vibrator section includes a frame supported by said cylinder assemblies.

4. The apparatus set forth in claim 3 wherein:

said support section includes an array of four of said cylinder assemblies mounted on said support plate and arranged in a substantially symmetrical pattern with respect to a central axis of said apparatus, said axis being substantially coincident with a longitudinal central axis of said tubular member.

5. The apparatus set forth in claim 1 including:

a manifold for distributing pressure fluid to and receiving fluid from respective ones of said cylinder assemblies, and flow control devices disposed between said cylinder assemblies and said manifold for effectively causing fluid flow through said cylinder assemblies during operation of said apparatus.

6. The apparatus set forth in claim 5 wherein:

said fluid flow circuit comprises a hydraulic fluid flow circuit including hydraulic accumulator means operably connected in circuit with said manifold for damping pressure and flow fluctuations in said hydraulic fluid flow circuit.

7. The apparatus set forth in claim 6 wherein:

said hydraulic fluid flow circuit includes plural accumulators connected in parallel for absorbing said pressure and flow fluctuations, respectively.

8. The apparatus set forth in claim 1 including:

pressure fluid drive motors operably connected to spaced apart rotatable shafts on said vibrator section, respectively, for rotatably driving said shafts to induce longitudinal vibratory forces imposed on said tubular member.

9. The apparatus set forth in claim 1 including:

means for supporting said tubular member on said vibrator section for rotation with respect to said vibrator section.

10. The apparatus set forth in claim 1 including:

means engageable with said tubular member for rotatably driving said tubular member with respect to said vibrator section while vibrations are imposed on said tubular member by said apparatus.

11. A vibrator apparatus for connection to a well tubular member for imparting longitudinal vibrations thereto, said vibrator apparatus comprising:

a vibrator section including a member adapted to be connected to an elongated well tubular member for transferring vibrations thereto;

a support section disposed between said vibrator section and a wellhead structure for supporting said apparatus on said wellhead structure, said support section including an array of plural pressure fluid cylinder assemblies mounted on said support section and arranged in a substantially symmetrical pattern with respect to a longitudinal axis of said tubular member; and a pressure fluid circuit including a pump and a manifold for receiving pressure fluid from said pump for distributing pressure fluid to respective ones of said cylinder assemblies and for receiving pressure fluid from said cylinder assemblies, respectively.

12. The apparatus set forth in claim 11 including:

flow control devices disposed between said cylinder assemblies and said manifold for effectively causing fluid flow through said cylinder assemblies during operation of said apparatus.

13. The apparatus set forth in claim 11 including:

pressure fluid accumulator means operably in circuit with said manifold for damping pressure and flow fluctuations in said circuit and generated by said cylinder assemblies.

14. The apparatus set forth in claim 13 wherein:

said circuit includes plural accumulators disposed in parallel in said circuit for absorbing said pressure and flow fluctuations, respectively.

15. The apparatus set forth in claim 11 including:

pressure fluid drive motors operably connected to respective rotatable shafts, respectively, for rotatably driving said shafts to induce longitudinal vibratory forces imposed on said tubular member.

16. The apparatus set forth in claim 11 including:

means for supporting said tubular member on said vibrator section for rotation with respect to said vibrator section.

17. The apparatus set forth in claim 16 wherein:

said means for supporting said tubular member for rotation comprises a bearing support member, a bearing assembly supported by said bearing support member and a member engaged with said bearing assembly for supporting said tubular member with respect to said vibrator section for rotation with respect to said vibrator section.

18. A vibrator apparatus for connection to a well tubular member for imparting longitudinal vibrations thereto, said vibrator apparatus comprising:

a vibrator section including a member adapted to be connected to an elongated well tubular member for transferring vibrations thereto;

a support section disposed between said vibrator section and a wellhead structure for supporting said apparatus on said wellhead structure, said support section including an array of plural pressure fluid cylinder assemblies mounted on said support section;

a pressure fluid circuit including a pump and a manifold for receiving pressure fluid from said pump for distributing pressure fluid to respective ones of said cylinder assemblies;

flow control devices disposed between said cylinder assemblies and said manifold for effectively causing fluid flow through said cylinder assemblies during operation of said apparatus; and plural accumulators disposed in parallel communication with said circuit for damping at least one of pressure and flow fluctuations in said circuit.

19. A vibrator apparatus for connection to a well tubular member for imparting longitudinal vibrations thereto, said vibrator apparatus comprising:

a vibrator section including a member adapted to be connected to an elongated well tubular member for transferring vibrations thereto, said vibrator section including a frame including opposed end walls and intermediate walls supporting spaced apart bearing assemblies, spaced apart, substantially parallel rotatable shaft members mounted in said bearing assemblies, respective eccentric weights mounted on said shafts, respectively, and a timing mechanism interconnecting said shafts for rotating said shafts in synchronization with each other to cause said weights to impart longitudinal vibratory forces on said tubular member; and a support section disposed between said vibrator section and a wellhead structure for supporting said apparatus on said wellhead structure, said support section including pressure fluid support and isolation members operably supporting said vibrator section.

20. The apparatus set forth in claim 19 wherein:

said shafts each support plural eccentric weights thereon and spaced apart substantially equidistant from a longitudinal central axis of said apparatus and which is substantially coincident with a central axis of said tubular member.

21. The apparatus set forth in claim 19 wherein:

said timing mechanism comprises gears mounted on said shafts, respectively, and meshed with each other to provide timed rotational movement of said shafts.

22. The apparatus set forth in claim 19 wherein:

said eccentric weights are supported on said shafts by removable clamp members whereby said eccentric weights may be exchanged for eccentric weights of different mass value.

23. The apparatus set forth in claim 19 wherein:

said frame includes a part operably connected to said pressure fluid support and isolation members of said support section, a top wall and opposed side walls forming an enclosure and at least a portion of said enclosure provides a chamber for said timing mechanism.

24. A vibrator apparatus for connection to a well tubular member for imparting longitudinal vibrations thereto, said vibrator apparatus comprising:

a vibrator section including a member adapted to be connected to an elongated well tubular member for transferring vibrations thereto;

a support section disposed between said vibrator section and a wellhead structure for supporting said apparatus on said wellhead structure, said support section including pressure fluid support and isolation members operably supporting said vibrator section; and means for supporting said tubular member on said vibrator section for rotation with respect to said vibrator section comprising a bearing support member, a bearing assembly supported by said bearing support member and a member engaged with said bearing assembly for supporting said tubular member with respect to said vibrator apparatus for rotation with respect to said vibrator apparatus.

25. The apparatus set forth in claim 24 including:

means for connecting said member supported on said bearing assembly to said bearing support member for retaining said tubular member nonrotatable with respect to said vibrator apparatus.

* * * * *